United States Patent [19]

Cruz

[11] 4,001,941

[45] Jan. 11, 1977

[54] GRAPHIC REPRODUCTION APPARATUS

[76] Inventor: Gustavo Joel Cruz, 2224 NW. Johnson St., Portland, Oreg. 97210

[22] Filed: Apr. 21, 1975

[21] Appl. No.: 569,830

[52] U.S. Cl. ..... 33/1 K; 33/86; 28/15; 35/26

[51] Int. Cl.[2] ..... B43L 13/00

[58] Field of Search ..... 33/277, 1 K, 1 B, 77, 33/20 R, 20 C, 18 C, 85, 86; 35/26; 28/15

[56] References Cited

UNITED STATES PATENTS

| | | | |
|---|---|---|---|
| 241,801 | 5/1881 | Hagan | 35/26 |
| 353,919 | 12/1886 | Charman | 33/1 K |
| 574,605 | 1/1897 | Hailes | 33/1 K |
| 1,017,390 | 2/1912 | Dittrich | 33/86 |
| 1,282,382 | 10/1918 | Cross | 35/26 |
| 1,622,229 | 3/1927 | Ormiston | 33/1 K |
| 1,667,330 | 4/1928 | Odlin | 28/15 |
| 2,263,101 | 11/1941 | Perry | 33/277 |
| 3,086,296 | 4/1963 | Bergstrom | 35/26 |
| 3,209,336 | 9/1965 | Erikson et al. | 28/15 |
| 3,660,903 | 5/1972 | Caperton | 33/1 K |
| 3,939,564 | 2/1976 | Slawinski | 33/1 K |

FOREIGN PATENTS OR APPLICATIONS

| | | | |
|---|---|---|---|
| 876,389 | 11/1942 | France | 33/1 K |

*Primary Examiner*—Richard E. Aegerter
*Assistant Examiner*—John W. Shepperd
*Attorney, Agent, or Firm*—Klarquist, Sparkman, Campbell, Leigh, Hall & Whinston

[57] ABSTRACT

A set of four channel-like clips positioned on opposite edges of a canvas have fasteners to which elastic threads are secured to form a grid over the canvas. Some of the fasteners are spaced one distance apart from each other to form a first grid portion of a small scale and others are spaced apart a distance which is a multiple of the one distance to form a second grid portion of a larger scale. The clips are numbered and lettered. A second identical set of four clips positioned on opposite edges of a picture that is to be painted or drawn on the canvas have strings similarly arranged. The clips may be slid along the edges to locate the grid portions of the desired sizes at desired portions of the picture and the canvas, and the elastic cords over the canvas may be held to one side or temporarily removed during the painting to provide space while only temporarily interrupting the grid patterns.

3 Claims, 5 Drawing Figures

GRAPHIC REPRODUCTION APPARATUS

DESCRIPTION

This invention relates to new and improved graphic reproduction apparatus, and has for an object thereof the provision of new and improved graphic reproduction apparatus.

Another object of the invention is to provide an apparatus for superimposing coded grids over a canvas.

A further object of the invention is to provide an apparatus for forming grids of different scales over a canvas and picture.

Another object of the invention is to provide an apparatus forming a grid of elastic strings over a canvas which permits the strings to be deflected during painting to only temporarily destroy the grid and which may be easily removed and reinstalled.

Another object of the invention is to provide a gridded viewer.

Figure 1:
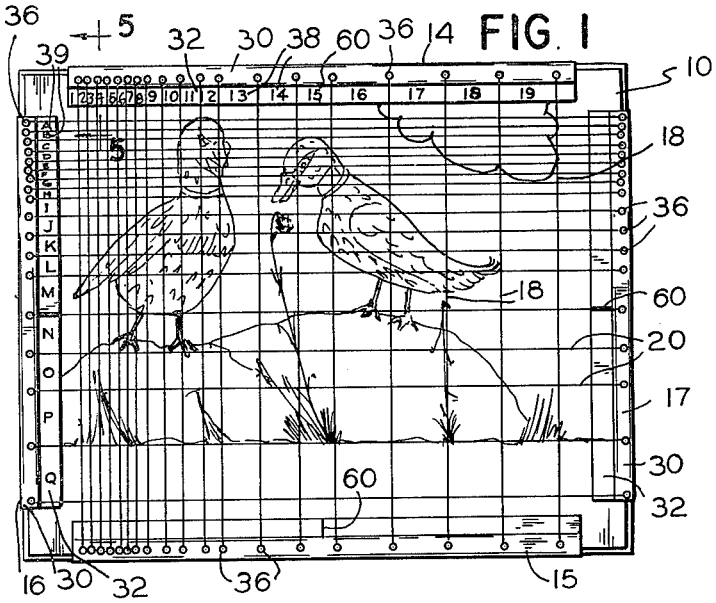
FIG. 1 is a front elevation view of a picture to be reproduced with a portion of a graphic reproduction apparatus forming one embodiment of the invention.
Figure 4:
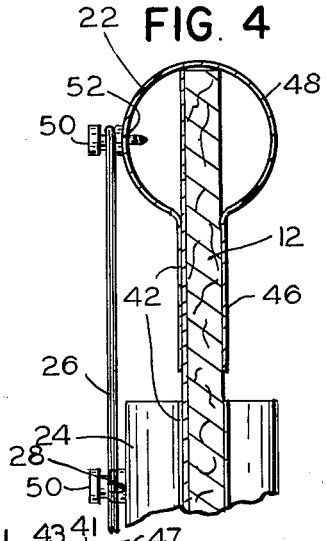
FIG. 4 is an enlarged, vertical, sectional view taken along line 4—4 of FIG. 3; and, FIG. 5 is an enlarged, vertical, sectional view taken along line 5—5 of FIG. 1.
Figure 2:
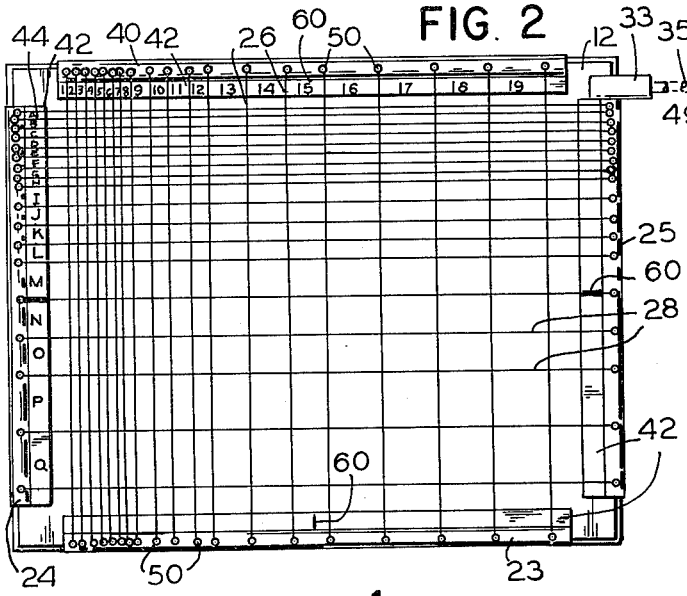
FIG. 2 is a front elevation view of a canvas with another portion of the graphic reproduction apparatus.
Figure 5:
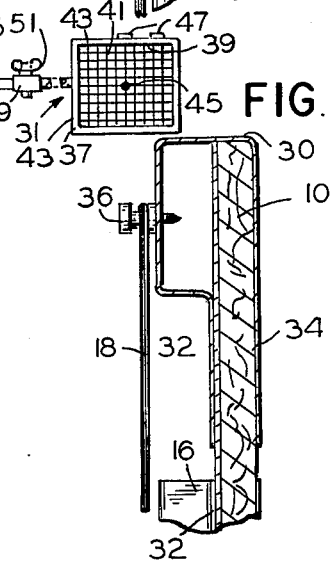
Figure 3:
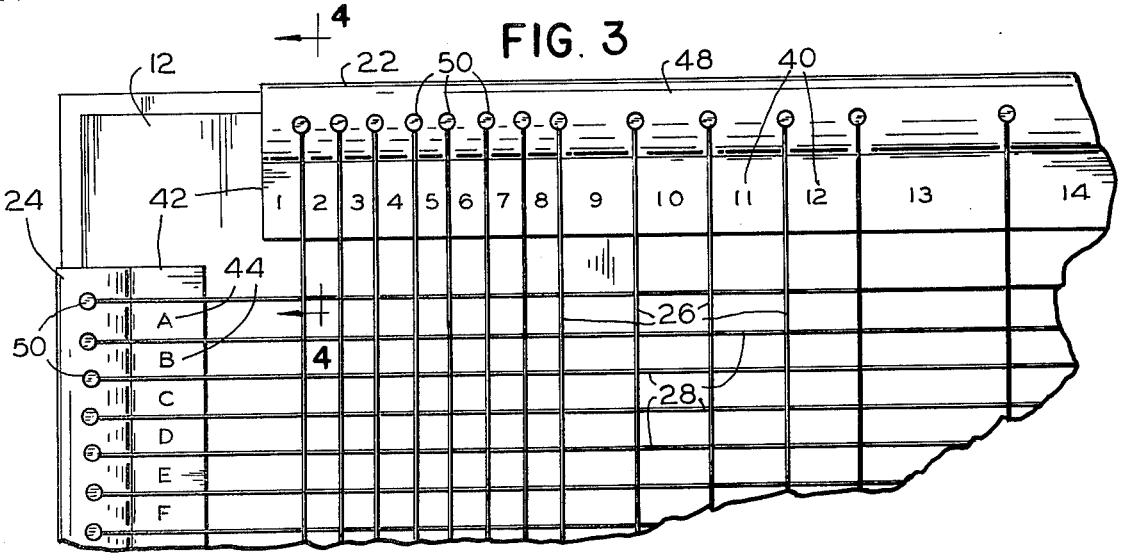
FIG. 3 is an enlarged, fragmentary, front elevation view of the canvas and the portion of graphic reproduction apparatus of FIG. 2.

Referring now in detail to the drawings, there is shown therein a picture 10 to be reproduced on a canvas 12 with first grid forming clips 14, 15, 16 and 17 and strings 18 and 20 on the picture 10, and second grid forming clips 22, 23, 24 and 25 and elastic strings 26 and 28 on the canvas 12. The strings 26 and 28 are positioned to form a grid superimposed on the canvas and identical to a grid formed by the strings 18 and 20 over the picture. This enables the artist to copy precisely the lines and colors of the picture, the elastic strings 26 and 28 being temporarily stretched out of the way in the portion of the picture which is being painted at any time.

For painting a landscape or other than reproducing another picture, a gridded viewer 31 may be used. The viewer may be held manually; may be placed over a photograph or sketch to be copied, or, as in the embodiment shown, may be mounted on the canvas 12 by a releasable clip 33 and an adjustable, hinged arm 35. The viewer includes a frame 37 held by the arm and a transparent panel 39 held flat by the frame 37. The panel may be of plastic material, and has grid lines 41 formed thereon identical to but on a smaller scale than the grid formed by the strings 26 and 28. The grid lines 41 are coded by indicia 43 at the edges of the panel, identically to the coding of the strings 26 and 28. A locating dot 45 is positioned at the center of the panel to enable the user to always bring the viewer precisely on target after the viewer has been moved. A clip 47 is provided for clipping a photograph or sketch to the back side of the panel. The arm 35 has a hinged joint 49 for adjustment, a wing nut and screw 51 being adapted to lock the joint in adjusted position. The clip 33 also may be released and relocated up or down the edge of the canvas, being fastened to the clip 25 if desired.

The clips 14–17 are identical as are the clips 22–25. Each clip 14–17 comprises a looped spring portion 30 and two strip or jaw portions 32 and 34 slidable along the picture when so desired. The spring portion 30 carries fasteners 36 to which the strings 18 are secured, and the strip portion 32 of the clip 14 has numerals 38 positioned between each pair of adjacent strings 18. Similarly, the strip portion 32 has letters 39 positioned between each pair of adjacent strings 20. Thus, the grid is coded, and each square of the grid over the picture can be readily identified by one of the numerals and one of the letters.

The grid formed by the elastic strings 26 and 28 just out from the front face of the canvas 12 is identical to that over the picture 10 and is coded identically with the coding of the grid of the picture by numerals 40 on front strip or jaw portion 42 of the clip 22 and letters 44 on strip or jaw portion 42 of the clip 24. Each clip 22–25 also has a rear gripping strip or jaw 46 and an enlarged, generally cylindrical spring portion 48. The clips may be of metal or plastic. Fasteners 50 have threaded shanks 52, preferably of the self-tapping type, screwed into holes in the spring portions 48. The end portions of the strings 18, 20, 26 and 28 all are fixed into loops and adapted to hook over fasteners and be held thereon by tension on the strings. The heads of the fasteners shown are knobs but may, of course, be hooks, or eyes. The fasteners 50 forming the squares 1–8 and A–H are spaced closely together one predetermined distance, e.g. one-quarter of an inch, to form a small scale grid, those forming the squares 9–12 and I–L are spaced farther apart, e.g. one-half of an inch, to form a larger scale grid. Similarly, the fasteners forming the squares 13–15 and M–O are spaced even farther, e.g. three-quarters of an inch form even larger scale grids and those forming the squares P and Q and 16–19 are spaced even farther, e.g. 1 inch to form the largest grid. Preferably, faint centerline marks 60 are formed on strips 32 and 42 and the clips can be positioned to position these marks on any desired ones of parallel lines formed temporarily on the picture and canvas. Thus, the pairs of clips can be slid along the picture and canvas to locate grids of the desired scale at any desired portion of each of the picture and the canvas. Also, while the clips 14–17 and 22–25 have been disclosed as being of the same size and scale, the clips like the clips 14–17 but of, for example, one-half or twice the size of the clips 22–25, may be provided. Also, while the numerals 38 and 40 and letters 39 and 44 are shown on only the upper and lefthand clips, the corresponding numerals and letters may be provided on the bottom and righthand clips.

What is claimed is:

1. In a graphic reproduction apparatus, canvas means including a rectangular frame and a canvas on the frame, a plurality of fastening means, two pairs of elongated, generally C-shaped mounting clips extending over a substantial portion of the frame, said clips having strip-like jaw portions and loop-like spring portions connecting the jaw portions and adapted to temporarily clip to the front and back of the two pairs of opposite edge portions of the frame and rigidly secured to and each clip carrying a plurality of spaced apart fastening means, and a plurality of highly stretchable elastic strings each secured under tension to a pair of the fastening means, on the opposite clips the strings extending at right angles to each other to form a grid over the canvas, whereby the strings can be temporarily deflected to clear an area on the canvas for working thereon.

2. The graphic reproduction apparatus of claim 1 wherein the mounting clips are adjustable along the edges of the canvas to position the grids over selected portions of the canvas.

3. The graphic reproduction apparatus of claim 2 including indicia positioned along at least one of the horizontal edge portions of the canvas between the strings and at least one of the vertical edge portions of the canvas between the strings.

* * * * *